United States Patent [19]

Sager

[11] Patent Number: 4,783,932

[45] Date of Patent: Nov. 15, 1988

[54] CENTERLESS GRINDER CONSTRUCTION

[76] Inventor: Russell J. Sager, 109 Bay Shore Dr., Bay City, Mich. 48706

[21] Appl. No.: 13,346

[22] Filed: Feb. 11, 1987

[51] Int. Cl.[4] ..... B24B 5/30

[52] U.S. Cl. ..... 51/103 R

[58] Field of Search ..... 51/103 R, 103 C; 60/487, 489

[56] References Cited

U.S. PATENT DOCUMENTS

| | | | |
|---|---|---|---|
| 3,534,507 | 10/1970 | Barhorst | 51/103 R |
| 4,051,634 | 10/1977 | Fisher | 51/103 R |
| 4,663,937 | 5/1987 | Cullin | 60/487 |

FOREIGN PATENT DOCUMENTS

| | | | |
|---|---|---|---|
| 0008384 | of 1915 | United Kingdom | 60/489 |

*Primary Examiner*—Frederick R. Schmidt
*Assistant Examiner*—Blynn Shideler
*Attorney, Agent, or Firm*—Learman & McCulloch

[57] ABSTRACT

A centerless grinder having a rotary grinding wheel and a rotary regulating wheel wherein the regulating wheel is adjustable toward and away from the grinding wheel and has its axis of rotation rockable in a substantially horizontal plane. An infinitely variable speed mechanism is coupled to the regulating wheel in such manner as to enable the drive mechanism and the drive coupling to move conjointly with the regulating wheel. The coupling mechanism resists unwanted changes in the speed of rotation of the regulating wheel and absorbs shocks that result from the replacement of finished workpieces with unfinished workpieces.

4 Claims, 2 Drawing Sheets

CENTERLESS GRINDER CONSTRUCTION

This invention relates to a centerless grinder of the kind having a rotary grinding wheel and a rotary regulating wheel with a gap therebetween in which a workpiece may be accommodated for grinding.

BACKGROUND OF THE INVENTION

Centerless grinders are well known and conventionally comprise a base on which a rotary grinding wheel is mounted for rotation in one direction about a substantially horizontal axis and a regulating wheel which confronts, but is spaced from, the grinding wheel and which is mounted on the base for rotation in the same direction about an axis. The axis of rotation of the regulating wheel frequently is inclined somewhat to the horizontal so as to enable a workpiece accommodated in the gap between the grinding and regulating wheels to be fed automatically through such gap as the workpiece is ground.

It is conventional to mount the grinding wheel, the regulating wheel, or both, for adjustment toward and away from one another and thereby vary the gap between such wheels. Adjustability of the gap is necessary so as to enable the grinding machine to accommodate workpieces of different diameters and also to compensate for wear of the grinding wheel due to attrition and dressing. Although conventional centerless grinders include adjusting mechanisms for these purposes, adjusting means should be provided to compensate for changes in the peripheral speed of the grinding wheel because of the reduction in its diameter due to such attrition and dressing. It is believed that some centerless grinders provide one, or possibly two, input driving speeds for the grinding wheel or regulating wheel, but in those instances in which the grinder is used to grind workpieces to extremely small tolerances, such limited speed adjustments are inadequate.

Apparatus constructed in accordance with the invention overcomes the prior art inadequacy by providing an infinitely adjustable drive mechanism for the regulating wheel.

It is not uncommon for the coupling between the regulating wheel and its driving means to comprise a complex, geared transmission. Since the grinding wheel and the regulating wheel are driven in the same direction, and since the workpiece is positioned in the gap between the two wheels, and since the grinding wheel conventionally is the larger wheel and has a greater peripheral speed, the workpiece transmits a force from the grinding wheel to the regulating wheel that attempts to accelerate the latter. This phenomenon often is referred to as "back driving" and subjects the conventional geared transmission to severe strain and consequent wear. The adverse effect of the grinding wheel's tending to drive the regulating wheel via the workpiece is particularly noticeable in those instances in which workpieces are presented to the grinder in spaced intervals. Thus, when a ground workpiece is removed from the gap between the wheels, the speed of the regulating wheel may decrease, but when a fresh workpiece is introduced to the gap there is an immediate shock imposed on the regulating wheel drive mechanism due to the grinding wheel's attempting to accelerate the regulating wheel. As a consequence the speed of rotation of the regulating wheel varies, with adverse results on the finish of the workpiece, and the drive mechanism is subjected to wear.

Apparatus constructed in accordance with the invention overcomes these disadvantages of the known grinders by utilizing a regulating wheel drive mechanism which positively resists any tendency to be the regulating wheel.

SUMMARY OF THE INVENTION

A centerless grinder constructed in accordance with the invention includes a base on which is mounted a rotary grinding wheel and a body member on which is mounted a rotary regulating wheel. The body and, consequently, the regulating wheel are adjustable toward and away from the grinding wheel so as to vary the workpiece-accommodating gap therebetween. The regulating wheel is carried by a carrier which is mounted on the body for rocking movements about a substantially horizontal axis, thereby enabling the axis of rotation of the regulating wheel to be adjusted in a substantially vertical plane.

The regulating wheel is coupled by drive transmission means to rotary driving means. The regulating wheel wheel carrier and the driving means are rigidly secured to one another for conjoint movement not only toward and away from the grinding wheel, but also for conjoint rocking movements. Securing the regulating wheel carrier and the driving means to one another ensures that the drive transmitting means which couples the driving means and the regulating wheel will be maintained in a fixed position relative to the driving means and to the regulating wheel, thereby positively avoiding the imposition of undesirable forces on the drive transmitting means due to rocking of the axis of rotation of the regulating wheel.

The regulating wheel driving means associated with apparatus constructed in accordance with the invention is infinitely variable in speed, thereby enabling optimum relative peripheral speeds of the regulating wheel and the grinding wheel to be maintained for the most efficient grinding of a workpiece.

The driving mechanism for the regulating wheel incorporates self-actuating means which resist forces tending to rotate the regulating wheel backwards and which also absorb shocks caused by substituting a fresh workpiece for a finished one.

THE DRAWINGS

A preferred embodiment of the invention is illustrated in the accompanying drawings, wherein.

THE PREFERRED EMBODIMENT

Figure 1:
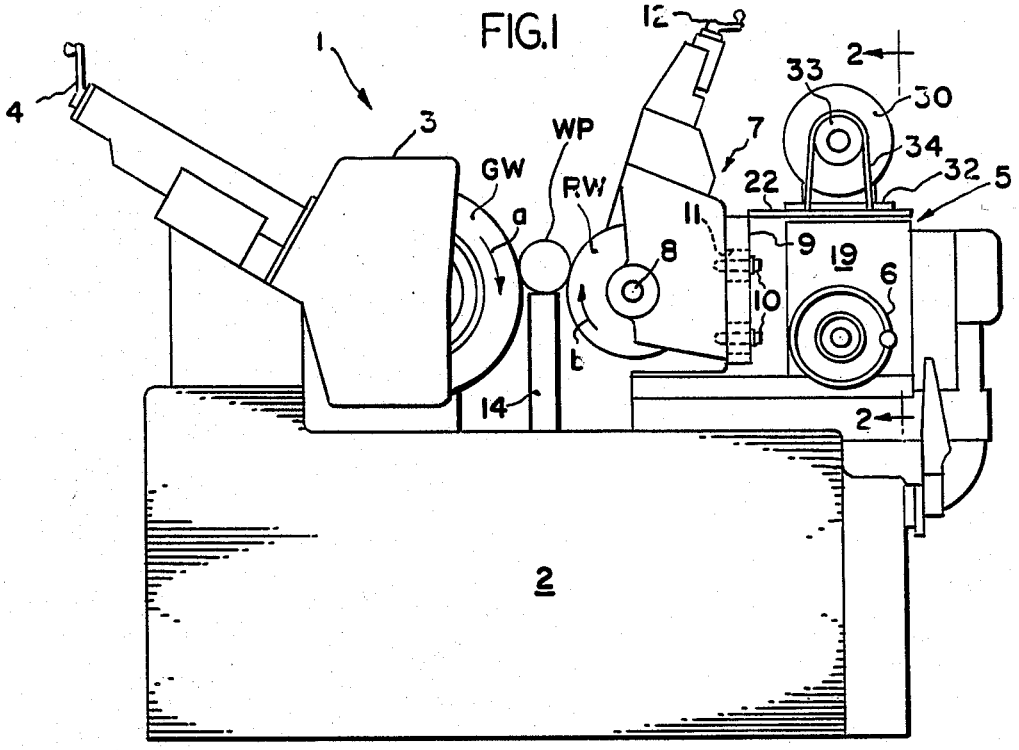
FIG. 1 is a side elevational view of a centerless grinding machine incorporating apparatus constructed in accordance with the invention.
Figure 3:
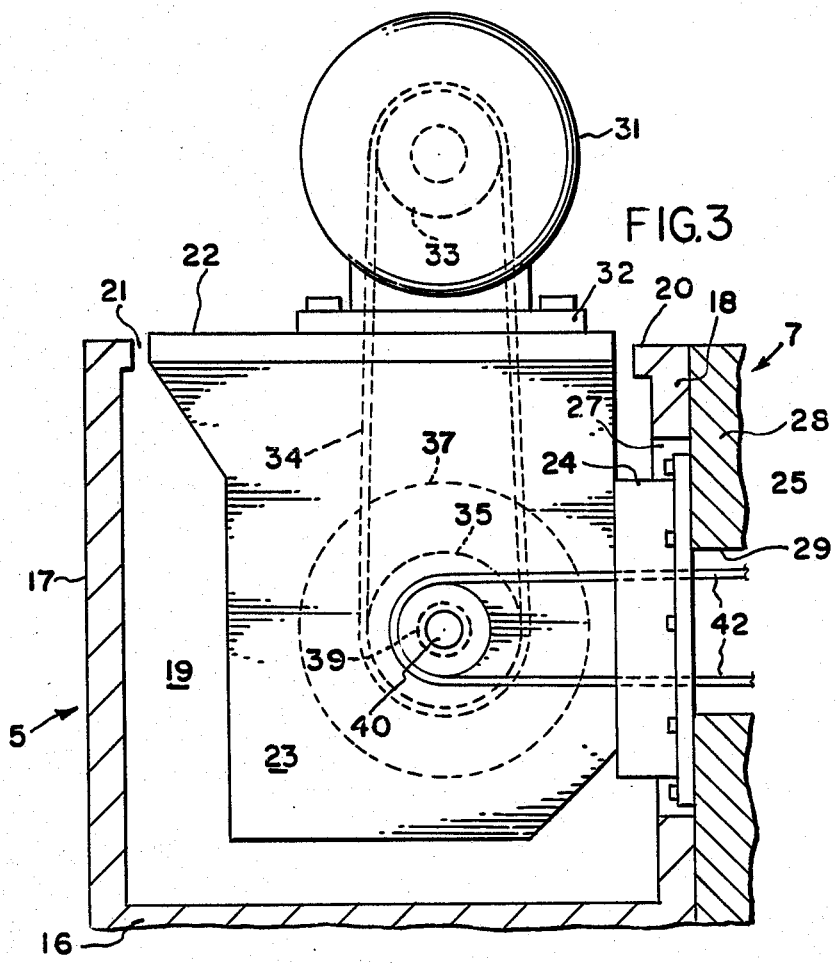
FIG. 3 is a sectional view taken generally on the line 3—3 of FIG. 2.
Figure 2:
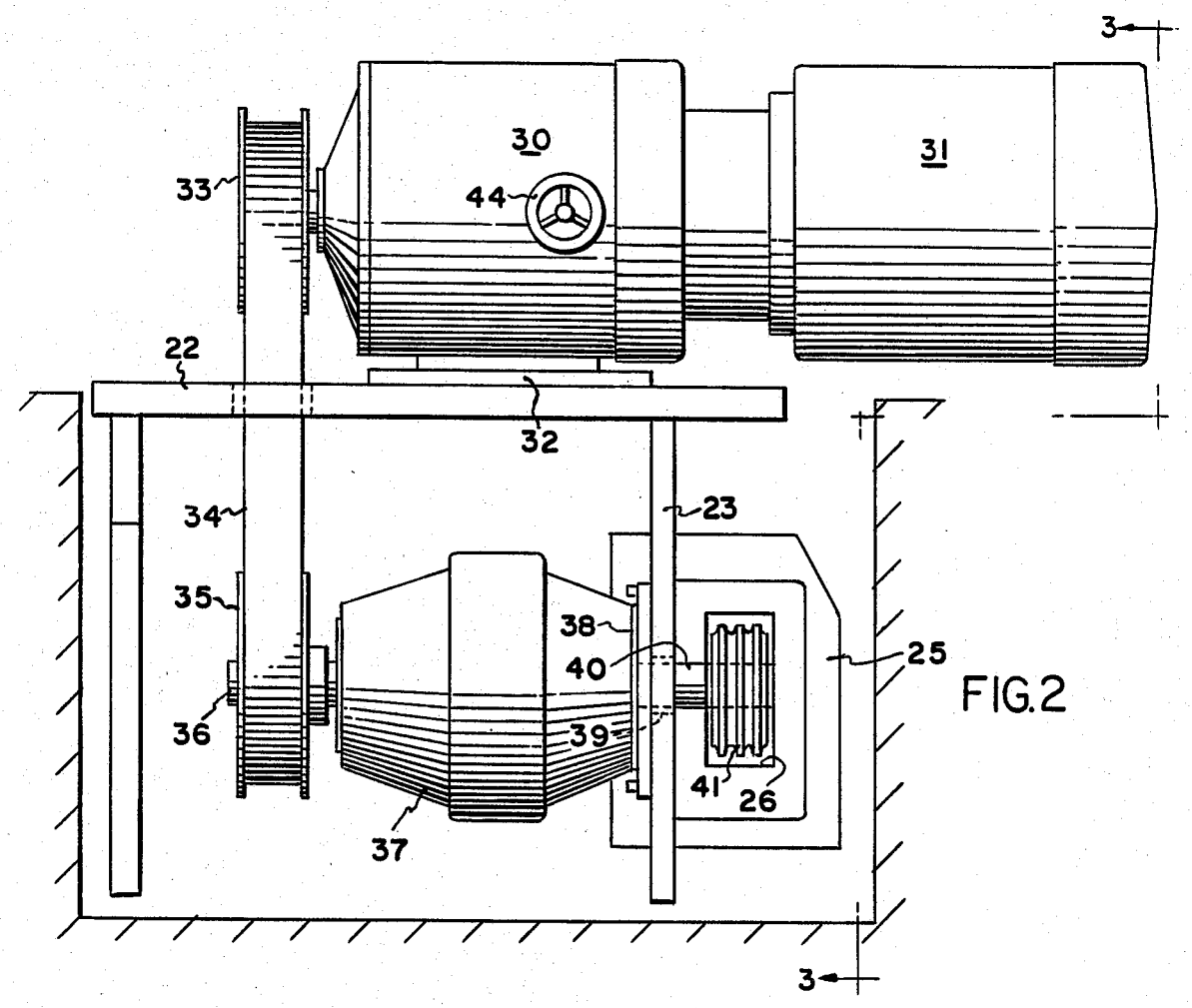
FIG. 2 is a fragmentary, greatly enlarged, sectional view taken generally on the line 2—2 of FIG. 1.
Figure 4:
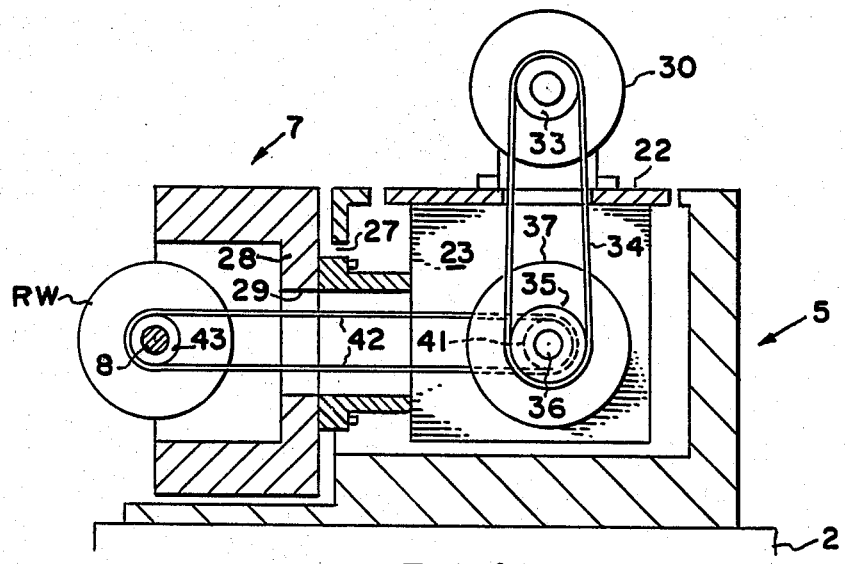
FIG. 4 is a somewhat diagramatic view, on a reduced scale, illustrating the opposite side of the apparatus shown in FIG. 3.

A centerless grinder 1 according to the invention has a base 2 on which is mounted a housing 3 in which is journaled a rotary grinding wheel GW driven in the direction of the arrow a by a suitable motor (not shown). The housing 3 is adjustable longitudinally of the base 1 by conventional adjusting means 4.

The machine 1 includes a body or housing 5 mounted on the base 2 for adjustments longitudinally of the latter toward and away from the ginding wheel GW by means of conventional adjusting means 6. At that end of the housing 5 which confronts the grinding wheel GW is a carrier 7 in which is journaled a regulating wheel shaft 8 on which is fixed a carried by the housing 5 regulating wheel RW. The carrier 7 abuts a mounting plate 9 and is provided with mounting bolts 10 at its opposite ends which extend through slots 11 formed in the mounting plate 9. The bolts 10 may be loosened, when desired, to enable the support 7, and consequently the regulating wheel RW, to be rocked about a substantially horizontal axis that is perpendicular to the axis of rotation of the grinding wheel GW. The bolts 10 then may be tightened to maintain the carrier 7 in any selected position of angular adjustment. The carrier 7 is adjustable vertically by means of a conventional adjusting mechanism 12 so as to position the axis of the shaft 8 at a desired level.

Between the grinding wheel GW and the regulating wheel RW is a support 14 on which a cylindrical workpiece WP may be supported. The gap between the grinding wheel GW and the regulating wheel RW may be adjusted by either or both of the respective adjusting means 4 and 6 to enable the workpiece WP to be engaged by the peripheries of both of the wheels.

The housing 5 has a bottom 16 provided with guideways or the like (not shown) to facilitate its adjustment longitudinally of the base 2, i.e., toward and away from the grinding wheel GW. The housing 5 also has a rear wall 17, a front wall 18, and side walls 19. The housing also has an upper wall 20 provided with an opening 21. Accommodated in the opening 21 is a support or mounting plate 22 of less area than that of the opening 21. Fixed to and depending from the lower surface of the plate 22 is a mounting plate 23 at the forward end of which is fixed an extension 24 that is welded or otherwise suitably fixed to a generally rectangular frame 25 having an opening 26 therein. The front wall 18 of the housing 5 has an opening 27 therein through which the extension 24 and the mounting frame 25 freely extend. The mounting frame 25 is secured by bolts or the like to the rear wall 28 of the carrier 7, and such wall has an opening 29 therein.

Means is provided for effecting rotation of the regulating wheel RW and comprises an infinitely variable speed, integrated, hydrostatic pump-motor coupling unit 30 of known construction, such as that produced by Dana Corporation under the trademark HSV and described in its bulletin No. MTP-003-85. In essence, the coupling unit 30 has a variable displacement radial piston pump that drives a fixed displacement radial piston motor. The coupling unit is driven by a suitable constant speed electric motor 31 having its output shaft connected to the drive unit 30 in a conventional manner. The driver motor 31 and the coupling unit 30 are mounted by supports 32 on the common support plate 22 and the unit 30 has its output shaft fixed to a driving pulley or sprocket wheel 33 around which is trained a driving belt or chain 34 which also is trained around a pulley or sprocket wheel 35 fixed on the input shaft 36 of a geared speed reducer 37 of known kind. The speed reducer 37 has a mounting flange 38 that is bolted or otherwise fixed to the mounting plate 23, and such plate has an opening 39 through which the output shaft 40 of the reducer 37 extends. Fixed to the shaft 40 is a pulley or sprocket wheel 41 around which is trained a drive transmitting belt or chain 42 which extends through the opening 29 in the rear wall 28 of the carrier 7 and is trained around a sprocket wheel or pulley 43 that is fixed to the shaft 8 of the regulating wheel RW.

The construction and arrangement of the regulating wheel driving mechanism and its support are such that the mounting plate 22 is secured rigidly to the rear wall 28 of the regulating wheel carrier 7, but is not secured to the base 2 or the housing 5. Accordingly, the driving means, the regulating wheel RW, and the drive coupling means are movable as a unit and the axes of rotation of the coupling unit 30, the drive motor 31, the reducer 37, and the regulating wheel shaft 8 are maintained fixed at all times in parallel relationship. Thus, whenever the regulating wheel housing carrier 7 is rocked to tilt the axis of the shaft 8, the mounting plate 22 and the drive components 30, 31, and 37, together with drive transmitting chains or belts 34 and 42, also are rocked to the same extent.

Since the drive motor, the drive coupling unit, and the regulating wheel RW are fixed to the regulating wheel carrier 7, movement of the latter by the housing 5 longitudinally of the base 2 also will be imparted to the drive and drive transmitting units. Such movements of the regulating wheel carrier 7 and the regulating wheel are possible because of the securing of the carrier 7 to the mounting plate 9 of the housing 5.

Conventionally, and as is shown in FIG. 1, the grinding wheel GM is of considerably larger diameter than the regulating wheel RW. The grinding wheel thus has greater mass and more inertia than the regulating wheel.

In the operation of the apparatus, the grinding wheel GW is caused to rotate in the direction of the arrow a in a conventional manner by a suitable motor (not shown) and the regulating wheel RW is caused to rotate in the direction of the arrow b by means of the drive motor 31 and the coupling unit 30. Either or both of the driving and regulating wheels is adjusted to provide a sufficient gap therebetween as to accommodate the workpiece WP for grinding. The regulating wheel also is adjusted by adjusting means 12 so that its axis of rotation is at a level somewhat below the central axis of the workpiece WP, as is conventional.

The regulating wheel carrier 7 is adjusted, by manipulation of the bolts 10, so as to tilt the axis of rotation of the regulating wheel an amount sufficient to effect feeding of the workpiece in one direction or the other through the gap between the grinding and regulating wheels. The speed of rotation of the regulating wheel RW is set by manipulation of a valve adjusting wheel 44 on the coupling unit 30 which regulates the rate of rotation of its output shaft. A workpiece WP then may be introduced to the gap between the grinding and regulating wheels for grinding.

As the grinding operations progress, the grinding wheel becomes worn due to attrition and dressing. The diameter of the grinding wheel, therefore, gradually decreases. As a consequence, the peripheral speed of the grinding wheel decreases and the size of the gap between the grinding wheel and the regulating wheel increases.

The size of the gap between the grinding and regulating wheels may be maintained substantially constant by operation of the adjusting means 6 to effect movement of the body 5, including the carrier 7, toward the grinding wheel. The speed of rotation of the workpiece may be maintained substantially constant by vary the speed of rotation of the regulating wheel RW by adjustment of the valve regulator 44 of the coupling unit 30. The adjustments of the position and speed of the regulating wheel may be effected by automatic means, rather than manually, if desired.

Whenever a workpiece is being ground the greater mass and inertia of the grinding wheel GW causes the latter to exert a force on the regulating wheel RW, via the workpiece, tending accelerate the speed of rotation of the regulating wheel. In the disclosed construction these tendencies are positively overcome by the hydrostatic pump-motor coupling unit 30. This is possible because, when a retarding force is imposed on the motor of the pump-motor assembly, the motor converts itself into a pump which opposes the pump of the pump-motor assembly. As a consequence, retardation of the speed of rotation of the regulating wheel is virtually non-existent and shocks caused by replacement of ground workpieces with fresh workpieces are absorbed by the pump-motor assembly.

The disclosed embodiment is representative of a presently preferred form of the invention, but is intended to be illustrated rather than definitive thereof. The invention is defined in the claims.

I claim:

1. A centerless grinder construction comprising a base; a rotatable grinding wheel mounted on said base for rotation about an axis; a body member mounted on said base for linear movements toward and away from said grinding wheel; a rotatable regulating wheel; carrier means mounting said regulating wheel for rotation about an axis spaced from the axis of said grinding wheel; adjustable mounting means mounting said carrier means on said body member for linear movements with said body member and for rocking movements relative to said body member about an axis normal to the axis of rotation of said regulating wheel; support means secured directly to said carrier means for movements therewith; driving means rotatable about an axis spaced from and parallel to the axis of rotation of said regulating wheel; drive transmission means rotatable about an axis spaced from and parallel to the axis of rotation of said regulating wheel, said transmission means including a hydrostatic pump-motor assembly coupling said driving means and said regulating wheel for rotating the latter, said transmission means having an infinitely variable speed output and being operable to maintain substantially constant any selected output speed; and means securing said driving means and said transmission means directly to said support means whereby said driving means, said transmission means, and said regulating wheel are conjointly and bodily movable relative to said body member about said normal axis.

2. The construction according to claim 1 wherein the axes of said regulating wheel and said driving means are at vertically spaced levels.

3. The construction according to claim 1 wherein said driving means comprises a constant speed motor connected to said transmission means.

4. The construction according to claim 1 wherein said transmission means includes a speed reduction unit between said assembly and said regulating wheel.

* * * * *

UNITED STATES PATENT AND TRADEMARK OFFICE

CERTIFICATE OF CORRECTION

PATENT NO. : 4,783,932

DATED : November 15, 1988

INVENTOR(S) : Sager

It is certified that error appears in the above-identified patent and that said Letters Patent is hereby corrected as shown below:

Column 3, line 7, delete "carried by the housing 5"

Column 3, line 8, after "9", insert -- carried by the housing 5 --

Column 3, line 17, insert -- also -- after "7".

Column 3, line 49, insert -- and sold -- after "produced".

Column 3, line 57, change "driver" to -- drive --.

Column 4, line 67, change "vary" to -- varying --.

Signed and Sealed this

Ninth Day of May, 1989

*Attest:*

*Attesting Officer*

DONALD J. QUIGG

*Commissioner of Patents and Trademarks*